US008517217B2

(12) United States Patent
Kraus

(10) Patent No.: US 8,517,217 B2
(45) Date of Patent: Aug. 27, 2013

(54) CONTAINER

(75) Inventor: Sebastian Kraus, Darmstadt (DE)

(73) Assignee: Kao Germany GmbH, Darmstadt (DE)

( * ) Notice: Subject to any disclaimer, the term of this patent is extended or adjusted under 35 U.S.C. 154(b) by 1012 days.

(21) Appl. No.: 12/440,705

(22) PCT Filed: Aug. 24, 2007

(86) PCT No.: PCT/EP2007/058813
§ 371 (c)(1),
(2), (4) Date: Mar. 10, 2009

(87) PCT Pub. No.: WO2008/031704
PCT Pub. Date: Mar. 20, 2008

(65) Prior Publication Data

US 2010/0019000 A1 Jan. 28, 2010

(30) Foreign Application Priority Data

Sep. 12, 2006 (EP) ..... 06019046

(51) Int. Cl.
*B65D 83/00* (2006.01)

(52) U.S. Cl.
USPC ..... 222/82; 222/397; 222/399; 222/330; 222/402.14; 413/12; 169/9; 220/89.2

(58) Field of Classification Search
USPC ..... 222/82, 330, 399, 402.14, 402.16, 222/635, 394–397, 402.1; 413/12; 220/203.08, 220/624, 89.1–89.4; 169/9, 71; 137/467
See application file for complete search history.

(56) References Cited

U.S. PATENT DOCUMENTS

| | | | | |
|---|---|---|---|---|
| 2,670,755 | A * | 3/1954 | Kendrick | 137/467 |
| 3,363,810 | A * | 1/1968 | Meshberg | 222/397 |
| 3,613,960 | A * | 10/1971 | Beard | 222/330 |
| 3,880,187 | A * | 4/1975 | Kneusel | 137/843 |
| 4,319,697 | A * | 3/1982 | De Barth | 222/80 |
| 4,402,430 | A * | 9/1983 | Fox et al. | 222/183 |
| 4,606,367 | A * | 8/1986 | Britt | 137/15.12 |
| 4,635,822 | A * | 1/1987 | Klawitter | 222/82 |
| 5,232,124 | A * | 8/1993 | Schneider et al. | 222/1 |
| 2005/0145284 | A1 * | 7/2005 | Sarajian et al. | 137/854 |

FOREIGN PATENT DOCUMENTS

| | | |
|---|---|---|
| EP | 0460289 A2 | 12/1991 |
| FR | 1499739 A | 10/1967 |
| FR | 2568228 A1 | 1/1986 |

OTHER PUBLICATIONS

English Language Abstract for FR 1499739, furnished Mar. 10, 2009 for document published Oct. 27, 1967.
English Language Abstract for FR 2568228, furnished Mar. 10, 2009 for document published Jan. 31, 1986.

* cited by examiner

*Primary Examiner* — Parl R Durand
*Assistant Examiner* — Andrew P Bainbridge
(74) *Attorney, Agent, or Firm* — Norris McLaughlin & Marcus PA

(57) ABSTRACT

An aerosol can has a dispensing valve at one end and discharge device at another end that allows the pressurized can to be safely depressurized. The discharge device has two elements that collectively fit into a wall of the aerosol can. The second element has a through passage within itself and is threadingly connected to the first element. The first element can be rotated such that the second element can move toward the interior of the aerosol can, which in turn opens the through passage to allow pressurized air to exit the can safely.

11 Claims, 6 Drawing Sheets

CONTAINER

This application is a 371 application of PCT/EP2007/058813 filed Aug. 24, 2007, which claims priority to the EP application 06019046.9 filed Sep. 12, 2006.

FIELD OF THE INVENTION

The present invention relates to a container according to the preamble of Claim 1.

PRIOR ART

Containers of the type initially mentioned are widely used for aerosols, in particular in the field of cosmetics as well as body and hair care. For example, U.S. Pat. No. 3,880,187 discloses a pressure container according to the preamble and deals with the problem of reducing the risk of explosions due to the propellant which is contained in the container. For this purpose the container comprises a discharge device in the form of a stopper which is disposed in the bottom of the container. Upon reaching a certain internal pressure in the container, this stopper is expelled, so that the propellant can emerge. However this can only occur in the case of extremely high internal pressures, as the container bottom must also be deformed for the stopper to be expelled in U.S. Pat. No. 3,880,187.

As opposed to this, however, it would be of advantage if the propellant could be discharged by a user, irrespective of the internal pressure, for example before the container is thrown away. For this purpose JP 09142552 A proposes a container which comprises a stopper with a closed through-opening in its bottom. The propellant can be discharged by opening the closed through-opening. However an aid such as, for example, a pair of scissors is required for this.

PRESENTATION OF THE INVENTION

The object of the present invention is therefore to provide a container of the type initially mentioned which enables a propellant to be easily discharged by a user.

This object is solved according to the invention by a container according to Claim 1. Particularly advantageous developments of the invention are indicated in the dependent claims.

The invention is based on the concept of inducing the discharge of the propellant through a specific relative movement instead of through considerable deformation of or damage to components of the container. For this purpose, according to the invention, given a container according to the preamble, the discharge device comprises a first and a second element, wherein at least the second element has at least one through-opening, and wherein, by displacing and/or rotating the second element in relation to the first element and/or the container body, the through-opening can be brought into a discharge position in which the through-opening connects the interior of the container body to the outside of the container body.

It is thus possible to achieve a discharge through a mere displacement or rotational movement, so that a user can carry out the discharge process without any problems.

According to one development of the invention, the second element moves in the direction of the interior of the container body when displaced or rotated into the discharge position. This ensures that high pressures in the interior of the container body cannot result in undesirable triggering of the discharge device.

In order additionally to prevent undesirable actuation of the discharge device from outside of the container body, according to one development of the invention, the container also comprises retaining means which impede a displacement or a rotation of the second element in relation to the first element towards the interior of the container body. These retaining means may be formed, for example, by friction or engagement elements which are disposed between the first and the second element. Moreover, the first and the second element may also be connected together via a predetermined breaking point, for example.

According to one development of the invention, at least the second element alternatively or additionally comprises stop means which oppose a displacement and/or rotation. In this case the stop means are supported at the container body, so that unwanted or undesirable actuation of the discharge device can be efficiently prevented.

The first and the second element can be configured in different ways within the scope of the present invention. However, according to one development of the invention, the first element is of a lower rigidity than the second element. The first element can as a result advantageously exert a sealing function on the discharge opening, and in this regard it is particularly preferable for the first element to consist of an elastomer, for example of rubber or similar. In contrast, it has proved to be advantageous for the second element for this to be made of an injection-molded plastics material. The second element can as a result easily be provided with the through-opening according to the invention.

In order, if required, to enable the discharge device to be easily and safely actuated, according to one development of the invention, at least the second element comprises actuating means. It has in this respect proved to be advantageous, with regard to easy production and user-friendly operability, for the actuating means to be selected from at least one notch, at least one projection and at least one lever.

Furthermore, according to one development of the invention, the second element is engaged with the first element via a thread. A relative displacement between the two elements when the second element is rotated can as a result be achieved in a particularly simple and effective manner.

Furthermore, according to one development of the invention, the second element comprises a point in order to penetrate the first element. This means that the first element does not have to comprise a through-opening at the outset, but can be formed as a completely sealing stopper which is only completely pierced when the discharge device is actuated by the second element.

A particularly advantageous application for the container according to the invention is obtained if the container body comprises at least two chambers in its interior, with a propellant preferably being provided in a chamber which is adjacent to the discharge device. In the case of containers of this kind the propellant is not expelled during use, instead serving solely to expel the active substance. In this case a large quantity of propellant remains in the container, so that a simple and effective discharge of the propellant is of particular advantage.

DETAILED DESCRIPTION OF PREFERRED EMBODIMENTS

Preferred embodiments of the present invention are described in detail in the following with reference to the accompanying drawings.

Figure 1:
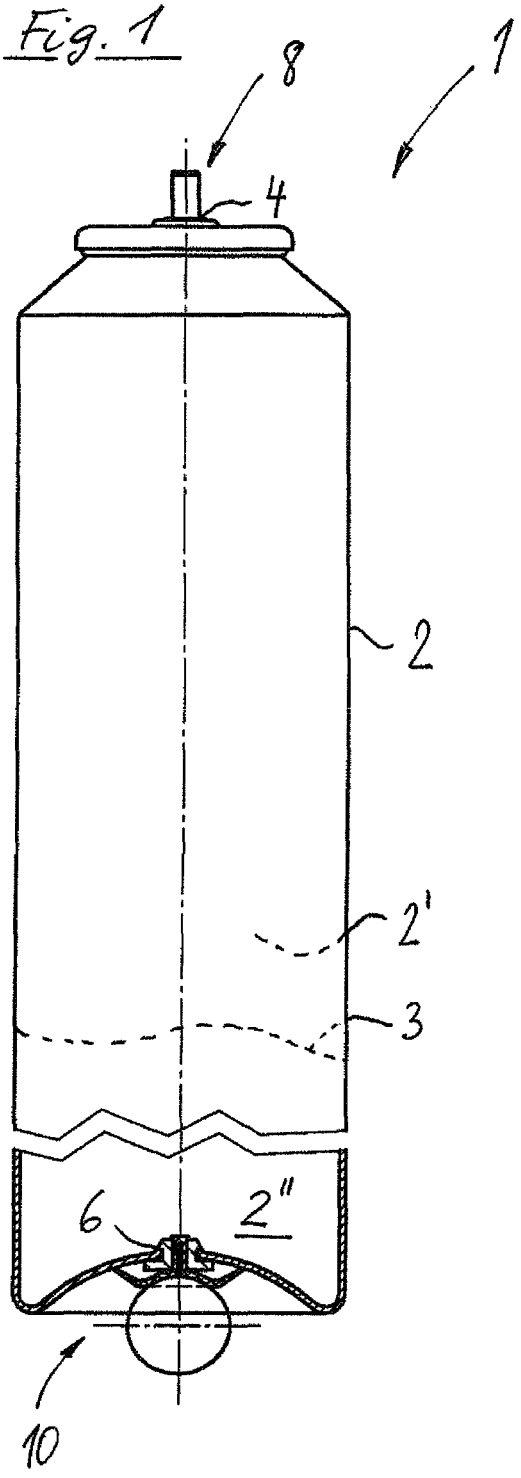
FIG. 1 is a schematic sectional view of a container according to the present invention.

FIG. 1 is a schematic sectional view of a container 1 as preferred embodiment of the invention. The container serves to hold aerosols, as are used, for example, in the field of (hair) cosmetics, although also with numerous other fields of application. The container 1 has a substantially cylindrical container body 2 which has at its top side an expulsion opening 4 in which an expulsion valve 8, for example an atomizer, is provided. At the opposite, lower side the container body has a discharge opening 6 in which a discharge device 10 is provided, this being considered in greater detail in the following.

The container 1 under consideration is a two-chamber container which comprises in its interior two chambers 2', 2" which are separated by a membrane or film 3. In this regard, a propellant is provided in the chamber 2" which is adjacent to the discharge device 10, while a medium which is to be sprayed as an aerosol is provided in the other chamber 2'.

Preferred embodiments of the discharge device 10 according to the invention are described in the following with reference to FIGS. 2 to 6. The figures show the discharge device 10 in an initial position and in a discharge position in each case.

Figure 2:
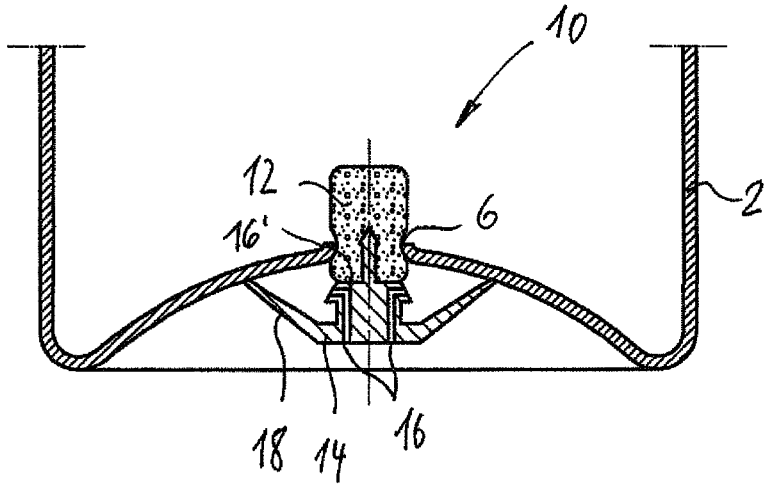
FIG. 2 is a schematic sectional view of a first embodiment of the discharge device according to the invention.
Figure 2:
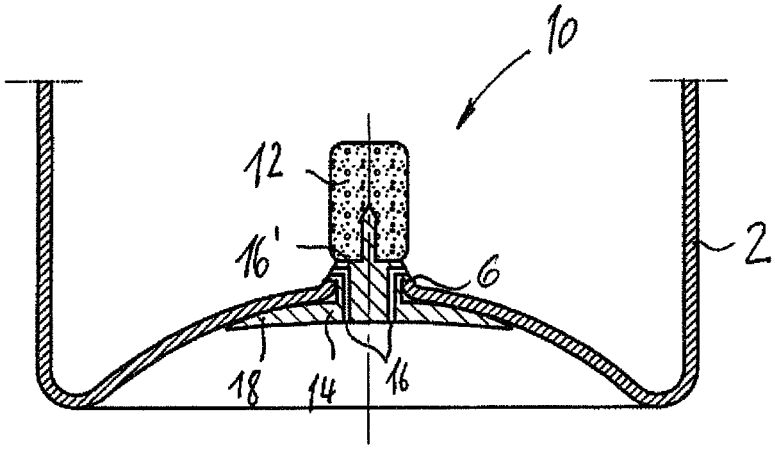

A first preferred embodiment of the discharge device 10 according to the invention is represented schematically in FIG. 2. This has a first element 12 which is inserted in the discharge opening 6 and formed, for example, by a rubber stopper. A second element 14 is positively connected to the rubber stopper (via a barb), is disposed on the outside of the container body and in this embodiment comprises two through-openings 16 which in each case have a deflection 16'. The second element 14 is supported via a resilient stop plate 18 on the outside of the container body 8.

The initial state (closed state) of the discharge device 10 is shown at the top of FIG. 2. In order to actuate the discharge device, a user can press with a finger or an appropriate object on the lower face of the second element 14 in order thus to push the first element 12 together with a part of the second element 14 through the discharge opening 6 such that it locks into place and the through-ducts 16 establish a connection between the interior of the container body 2 and the exterior of the container body 2. This discharge position is shown at the bottom of FIG. 2. The propellant gas which is provided in the chamber 2" can thus be discharged through the through-openings 16 to the outside.

When actuation takes place it is necessary, inter alia, for the resilient stop plate 18 to undergo deformation, which is to prevent undesirable actuation of the discharge device 10. Although this is not shown in the figures, the resilient stop plate 18 may comprise predetermined breaking points so that it is sheared off at a predetermined compressive force.

Figure 3:
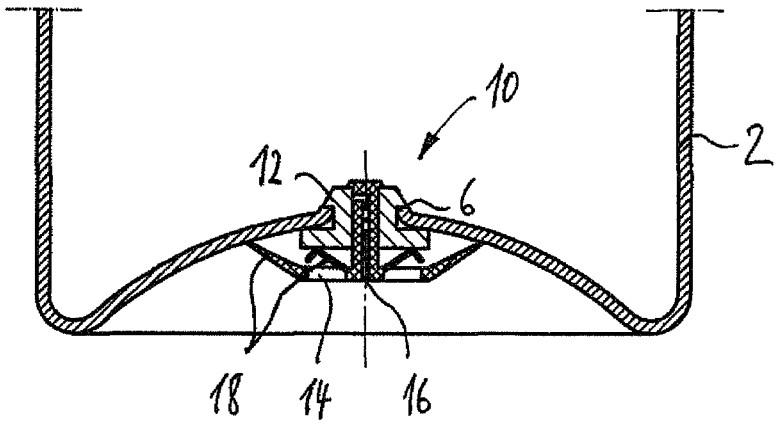
FIG. 3 is a schematic sectional view of a second embodiment of the discharge device according to the invention.
Figure 3:
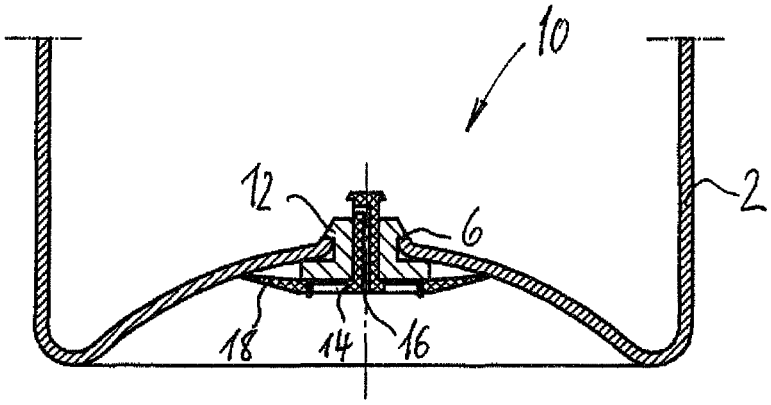

A second embodiment of the discharge device 10 according to the invention is represented schematically in FIG. 3. This basically comprises the same fundamental components as the first embodiment described with reference to FIG. 2. However an essential difference lies in the fact that the first element 12 is formed like a ring and the second element 14 is inserted in the inner through-opening of the ring-like, first element 12. It is also possible in this embodiment to establish a connection between the interior and the exterior of the container body via the through-opening 16 by actuating the second element 14 from below with a finger or an appropriate object.

Figure 4:
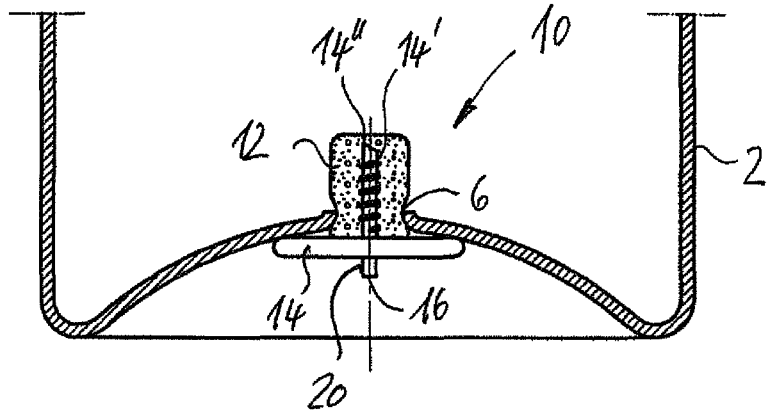
FIG. 4 is a schematic sectional view of a third embodiment of the discharge device according to the invention.
Figure 4:
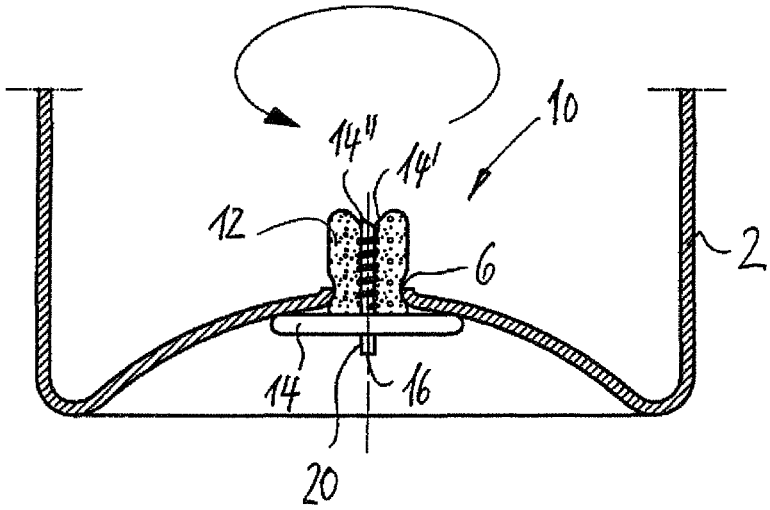

A third preferred embodiment of the discharge device 10 according to the invention is represented schematically in FIG. 4. In this embodiment the first element 12 is again formed as a rubber stopper which in the initial position (at the bottom of FIG. 4) completely seals the discharge opening 6 and initially has no through-opening. In addition, the second element 14 is in this embodiment provided with an external thread 14' and a point 14" which are embedded in the first element 12. The second element 14 also has actuating means 20, for example in the form of a projection, which can be gripped with the fingers.

In order to actuate the discharge device 10, the projection 20 is gripped with the fingers and the second element 14 is rotated about an axis of the through-opening 16. This results in the point 14" penetrating into the first element on account of the action of the thread 14' and drawing this towards it until a connection is finally established between the interior and the exterior of the container body via the through-opening 16.

Figure 5:
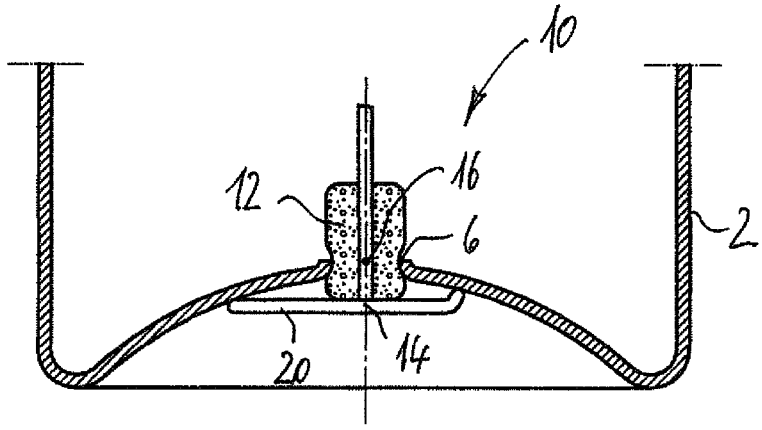
FIG. 5 is a schematic sectional view of a fourth embodiment of the discharge device according to the invention.
Figure 5:
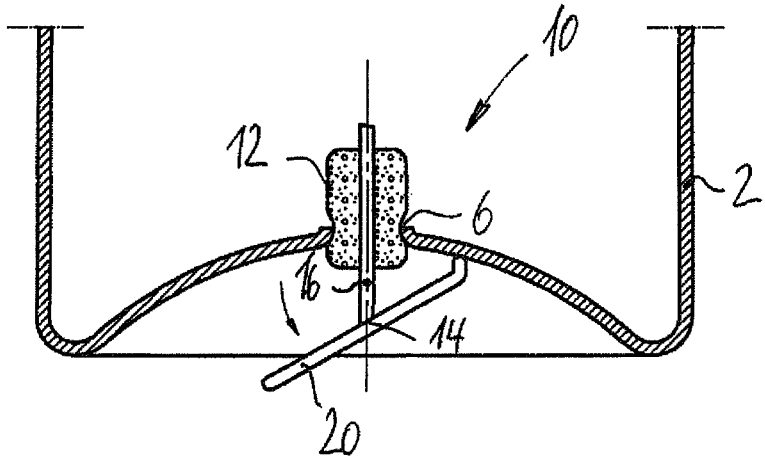

A fourth preferred embodiment of the discharge device 10 according to the invention is represented schematically in FIG. 5. Here, too, the first element is formed by a rubber stopper, although this is at the outset penetrated by the second element 14, which in this embodiment is formed like a needle. In this embodiment the through-opening 16 is configured such that the outlet opening of the through-opening 16 emerges laterally from the needle 14 at a point inside the first element 12 (in the initial state). In this embodiment the needle 14 is also provided at its outer end with a lever 20 which is supported on the outside of the container body. As soon as the lever 20 is pivoted in relation to the container body, the needle 14 is drawn out of the first element 12 until the bore of the through-opening 16 is uncovered and a connection between the interior and the exterior of the container body is therefore established.

Figure 6:
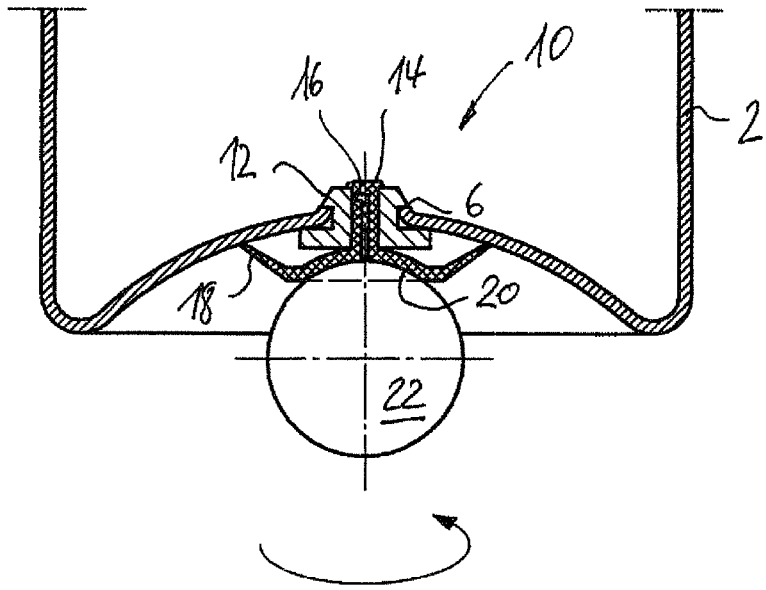
FIG. 6 is a schematic sectional view of a fifth embodiment of the discharge device according to the invention.
Figure 6:
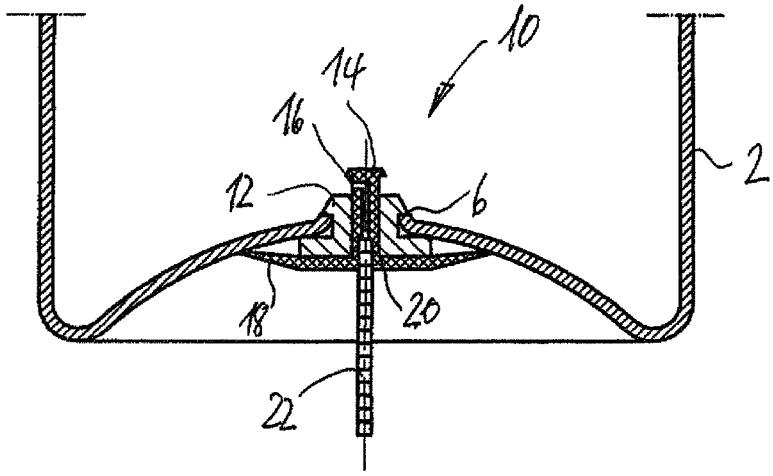

A fifth preferred embodiment of the discharge device 10 according to the invention is represented schematically in FIG. 6. This corresponds largely to the second embodiment which is shown in FIG. 3, although, unlike the latter, it has a notch 20 into which appropriate actuating means such as, for example, a screwdriver or a coin 22 can be introduced in order to enable the discharge device to be easily actuated or unlocked, for example through a quarter turn with a coin and simultaneous pressing.

The invention claimed is:

1. Container (1), in particular for aerosols, having a container body (2) which comprises an expulsion opening (4) and a discharge opening (6), an expulsion valve (8) which is provided in the expulsion opening (4), and a discharge device (10) which is provided in the discharge opening (6), wherein the discharge device (10) comprises a first (12) and a second (14) element, wherein at least the second element (14) has at least one through-opening (16) and is engaged with the first element (12) via a threaded passage (14'), and wherein, by displacing and/or rotating the second element (14) in relation to the first element (12) and/or the container body (2), the through-opening (16) can be brought into a discharge position in which the through-opening (16) connects the interior of the container body (2) to the outside of the container body, and wherein the second element (14) moves in the direction of the interior of the container body (2) when displaced or rotated into the discharge position and the second element comprises a stop means (18) which opposes a displacement or rotation, and said stop means comprises a predetermined breaking point.

2. Container according to claim 1, wherein it also comprises retaining means which impede a displacement or a rotation of the second element (14) in relation to the first element (12) towards the interior of the container body (2).

3. Container according to claim 1, wherein the first element (12) is of a lower rigidity than the second element (14).

4. Container according to claim 1 wherein the first element (12) consists of an elastomer, or of an injection-molded plastics material, and/or the second element (14) consists of an injection-molded plastics material.

5. Container according to claim 1, wherein at least the second element comprises actuating means (20) which are selected from at least one notch, at least one projection and at least one lever.

6. Container according to claim 1, wherein the second element (14) comprises a point (14") in order to penetrate the first element (12).

7. Container according to claim 1, wherein the container body (2) comprises at least two chambers (2', 2") in its interior, wherein a propellant is provided in a chamber (2") which is adjacent to the discharge device (10).

8. Container according to claim 1, wherein the stop means is supported at the container body.

9. Container according to claim 1, wherein the container comprises at least two chambers in its interior.

10. Container according to claim 9, wherein the chambers of the container are separated by a membrane or film.

11. Container according to claim 9, wherein a propellant is provided in a chamber which is adjacent to the discharge device.

* * * * *